United States Patent [19]

Quesnel et al.

[11] 3,930,337

[45] Jan. 6, 1976

[54] WINDOW REGULATORS FOR MOTOR VEHICLES

[75] Inventors: Marcel Quesnel; Bernard Julou, both of Billancourt, France;

[73] Assignee: Regie Nationale des Usines Renault, Billancourt; Automobiles Peugeot, Paris, both of France

[22] Filed: Mar. 13, 1975

[21] Appl. No.: 558,133

Related U.S. Application Data

[63] Continuation of Ser. No. 411,441, Oct. 31, 1973.

[30] Foreign Application Priority Data

Nov. 17, 1972 France ..... 72.40915

[52] U.S. Cl. ..... 49/227; 49/351

[51] Int. Cl.² ..... E05F 11/52

[58] Field of Search ..... 49/227, 348-351, 49/353

[56] References Cited

UNITED STATES PATENTS

| | | | |
|---|---|---|---|
| 2,298,515 | 10/1942 | Sullivan | 49/227 |
| 2,998,246 | 8/1961 | Probst | 49/227 |
| 3,020,040 | 2/1962 | King et al. | 49/351 X |
| 3,062,528 | 11/1962 | Martens | 49/227 |

*Primary Examiner*—Kenneth Downey
*Attorney, Agent, or Firm*—Stevens, Davis, Miller & Mosher

[57] ABSTRACT

This window regulator of the parallel-motion type comprises two parallel links with a front run channel rigid with a curved guider rail reproducing the movements of the glass-supporting bottom channel, a rolling member rigid with said bottom channel engaging said guide rail, one of said links being pivoted to a fixed pin of said bottom channel and to a pivot pin carried by a fixed plate supporting the control mechanism, the other link being rigid with a rotary member coupled to said mechanism and pivoted by means of another rolling member to the bottom channel and also to a pin rigid with said plate, this window regulator being intended more particularly for curved quarter-light windows of motor vehicles.

5 Claims, 5 Drawing Figures

WINDOW REGULATORS FOR MOTOR VEHICLES

This is a continuation of application Ser. No. 411,441, filed Oct. 31, 1973.

This invention relates in general to window regulators or winding systems, of the type currently used in motor vehicles, and has specific reference to a mechanism of this character, intended more particularly for curved quarter-panel windows of vehicles.

Window regulators comprising mechanisms of the parallel motion type are well known in the art; in some mechanisms of this character the vehicle links of the parallel motion do not move parallel to themselves and cause the window to move along a curved path. These known mechanisms are mostly objectionable on account of their delicate adjustment and the difficulty of holding the window in the selected position.

It is the essential object of the present invention to provide a window regulator or winder characterized primarily by a relatively simple mechanism and by the positive holding of the glass window in the selected position. The mechanism of the regulator according to this invention comprises two parallel movable links of a parallel motion, said links having one end rigid with the glass-supporting bottom channel, the window being movable in front and rear glass run channels, the glass movement being controlled by means of a crank and gear mechanism, the assembly being characterised in that the front run channel is rigid with a guide rail of which the radius of curvature corresponds to the radius of curvature of the window, said guide rail reproducing the combined longitudinal and transverse movements of the glass-supporting bottom channel, and that a rolling member carried by this glass-supporting bottom channel engages said guide rail, one of said links having one end pivoted in a manner known per se to a fixed point of said glass-supporting bottom channel and the other end pivoted to a pivot pin of a fixed plate supporting the control mechanism, the other link being rigid with a rotary member operatively connected to the control mechanism and pivoted on one side through a rolling member to the glass-supporting bottom channel and on the other side to a pin rigid with said plate.

Other features and advantages of the invention will appear as the following description proceeds with reference to the attached drawings illustrating diagrammatically by way of example a typical embodiment thereof. In the drawings.

Figure 1:
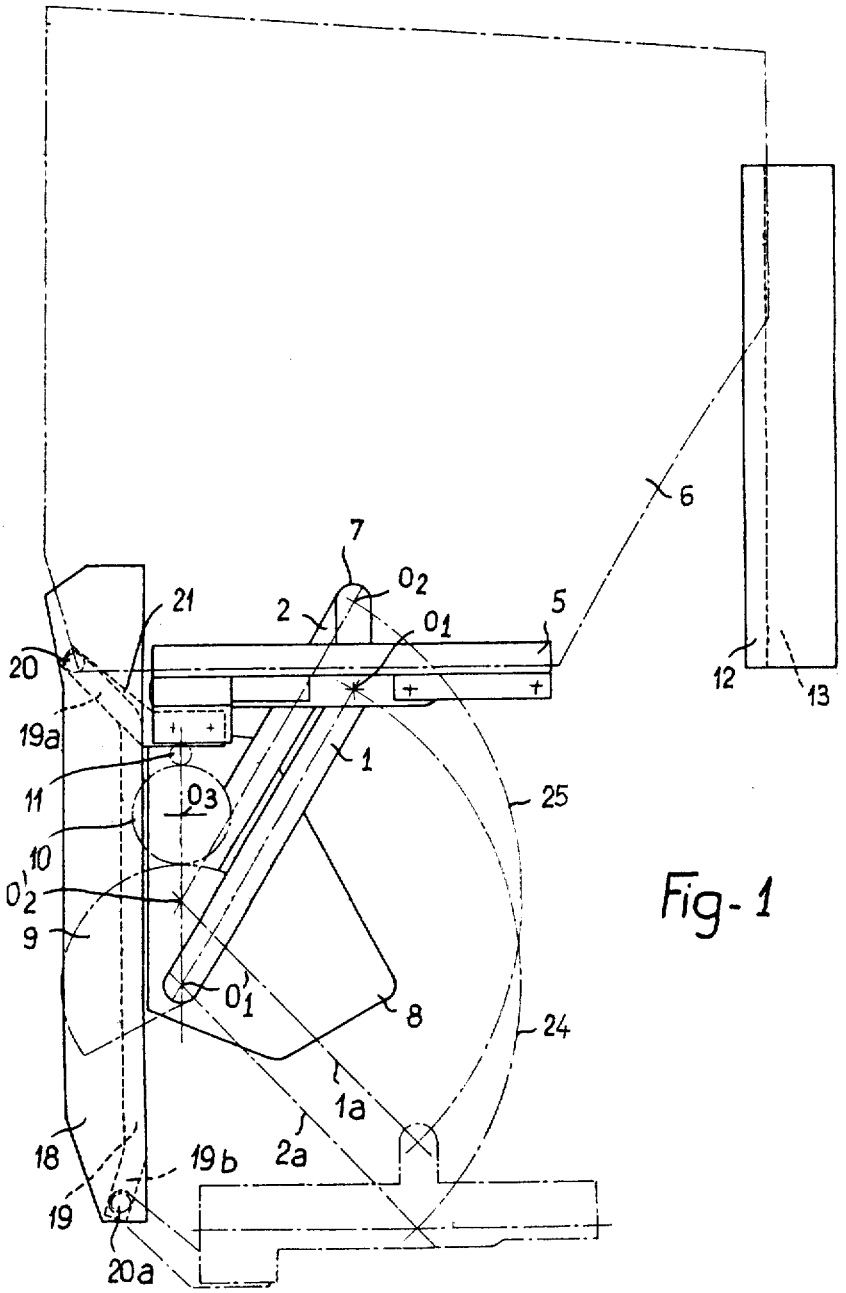
FIG. 1 is a diagrammatic front elevational view of the window regulator according to this invention.
Figure 5:
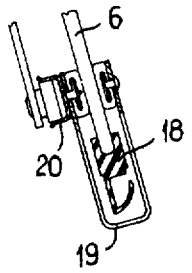
FIG. 5 is a section taken along the line V—V of FIG. 3.
Figure 2:
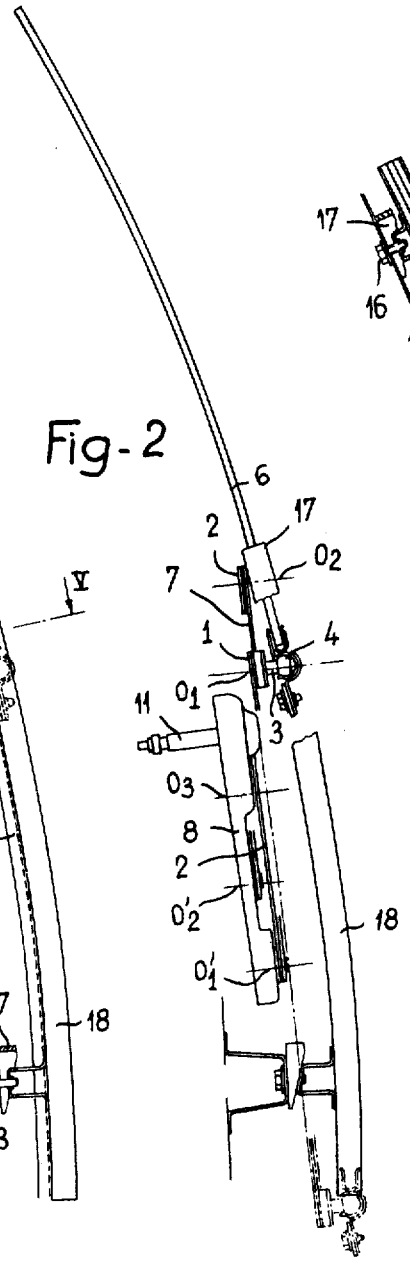
FIG. 2 is a side elevational view of the window regulator of FIG. 1, the front guide rail being partly removed, and in its uppermost position.

Referring first to FIGS. 1 and 2, it will be seen that the window regulator according to this invention comprises a conventional mechanism for actuating a parallel motion having two movable links 1, 2 of which one link 1 is pivoted at one end, at $O_1$ to the pivot pin 3 of a part-spherical roller 4 engaged in the central portion of a channel 5 constituting the bottom support of a curved glass or winding window 6, for example a quarter-panel window. The other link 2 is pivoted at one end $O_2$ to the upper portion of the vertical arm 7 of an inverted T-shaped member formed centrally of the glass-supporting bottom channel 5. The other end of the first link 1 is pivoted at $O_1'$ to the lower portion of a fixed plate 8 and the other end of the second link 2 is pivoted at $O_2'$ to the upper portion of this plate 8. The vertical lines $\overline{O_1 O_2}$ and $\overline{O_1' O_2'}$ of the pivot pins or axes constitute the other two sides of the parallel motion.

The lower portion of link 1 is rigid with a toothed segment 9 shown diagrammatically in dash and dot lines; this segment 9 is in constant meshing engagement with a toothed wheel 10 having a shaft $O_3$ rigid with the plate 8 and driven from a pinion-and-crank member 11 rotatably mounted on said plate 8.

Figure 4:
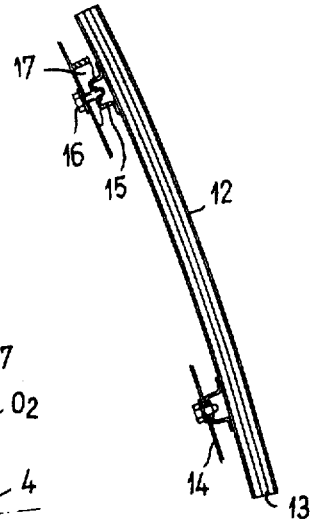
FIG. 4 is a side elevational view of the rear glass run channel.

The window 6 has its upper rear portion engaged in a curved run channel 12 lined with a flocked elastomer guide strip 13. As shown in FIG. 4, the run channel 12 is secured to the outer surface of the quarter-panel edge 14 by means of lugs 15 and screws 16 with the interposition of at least one adjustment wedge 17.

Figure 3:
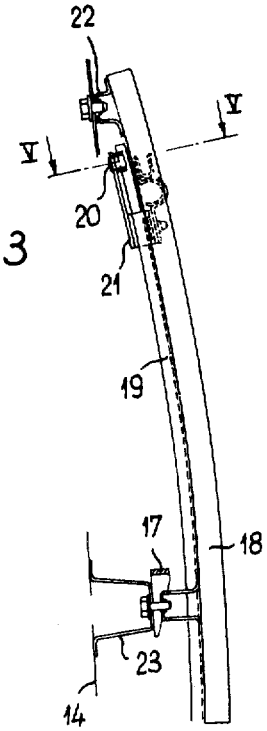
FIG. 3 is a side elevational view of the guide rail.

At its lower front portion the window 6 engages a curved run channel 18 receiving therein and at its ends a pair of flocked elastomer guide strips. The front run channel 18 is rigid with a guide rail 19 welded to its outer face and reproducing the window movement. To this end, the guide rail 19 comprises at its ends oblique portions inclined in the forward direction, the inclination of the upper inclined portion 19*a* of the rail in relation to the vertical being more pronounced than that of the lower portion 19*b*; these inclined or oblique portions 19*a* and 19*b* enable the window 6 to move along a path permitting avoidance of possible structural obstacles. The two ends of the guide rail are interconnected by a curved portion (see FIG. 3) having a curvature matching that of the window 6, this curvature being straight when seen in the projection of FIG. 1.

This guide rail 19 has engaged therein a part-spherical roller 20 carried by a bracket 2; rigid with the lower front portion of the bottom channel 5 supporting the window 6.

The guide rail 19 and the associated run channel 18 are secured jointly at their ends to the sheet 14 of the quarter-panel structure by means of corresponding lugs 22 and 23. The lower lug 23 is secured to a quarter-panel bracket 21 with the interposition of an adjustment wedge 17.

When it is desired to lower the glass 6, the pinion-crank 11 is rotated manually in the clockwise direction as seen in FIG. 1, thus rotating in the same direction the toothed segment 9 and consequently the link 1 which will thus pivot about the pin $O_1'$ and describe the arc 24, while the other link 2 follows by pivoting about the pin $O_2'$ and describing the arc 25. At the end of their strokes these links 1 and 2 will be in the corresponding positions 1*a* and 2*a*, shown only by the median line of these links, the glass-supporting bottom channel 5 lying then in the position 5*a* shown in dash and dot lines, with the part-spherical roller 20 in the lower position 20*a*.

The use of part-spherical rollers such as 20 permits of taking up the angular differences between the upper and lower glass positions.

Although a specific form of embodiment of this invention has been described hereinabove and illustrated in the accompaning drawings, it will readily occur to those skilled in the art that various modifications and changes may be brought thereto without departing from the scope of the invention as set forth in the appended claims.

What is claimed as new is:

1. In a window regulator or winder for motor vehicles, of the type comprising a curved window, a glass-supporting bottom channel, a pair of movable parallel links incorporated in a parallel motion system and having one end pivotally fixed to said glass-supporting bottom channel, a front run channel and a rear run channel in which said window is movable by means of a pinion-crank and gear mechanism, the front run channel being rigid with a guide rail having a radius of curvature in a vertical plane matching that of said window and having upper and lower end portions inclined to the vertical with unequal angles, the upper end portion being inclined upwards and the lower end portion being inclined downwards, said end portions being interconnected by a curved portion having said radius of curvature in said vertical plane, said rail reproducing the combined longitudinal and transverse movements of said glass-supporting bottom channel, and a rolling member carried by said glass-supporting bottom channel engaging said guide rail rigid with said front run channel, one of said links having one end pivoted to a fixed point of said glass-supporting bottom channel and the other end pivoted to a pivot pin of a fixed plate supporting the control mechanism, the other link being rigid with a rotary member operatively connected to the control mechanism and pivoted on one side through a rolling member to the glass-supporting bottom channel and on the other side to a pin rigid with said plate.

2. Window regulator as set forth in claim 1, wherein said guide rail has curved end portions inclined to the vertical with unequal angles, said inclined portions being interconnected by a curved portion constituting a straight portion when seen in vertical projection.

3. Window regulator as set forth in claim 1, wherein said rolling member consists of part-spherical rollers.

4. Window regulator as set forth in claim 1, wherein said front run channel receives the lower front portion of the window, and said rear run channel is engaged by the upper rear portion of the window.

5. A window regulator as set forth in claim 4, wherein the run channels and guide rails are jointly secured to the window structure by means of adjustment wedges.

* * * * *